United States Patent [19]

Roland

[11] 4,363,082

[45] Dec. 7, 1982

[54] PANEL CEILING AND LIGHT FIXTURE

[75] Inventor: George R. Roland, Paramus, N.J.

[73] Assignee: Levolor Lorentzen, Inc., Lyndhurst, N.J.

[21] Appl. No.: 181,740

[22] Filed: Aug. 26, 1980

[51] Int. Cl.[3] ..... F21S 1/14

[52] U.S. Cl. ..... 362/148; 362/219; 362/223; 362/225; 362/307; 362/365; 362/406

[58] Field of Search ..... 362/148, 150, 217, 219, 362/223, 225, 260, 300, 307, 329, 365, 366, 404, 408

[56] References Cited

U.S. PATENT DOCUMENTS

| | | | |
|---|---|---|---|
| 2,398,507 | 4/1946 | Rolph | 362/148 |
| 2,973,177 | 2/1971 | Stubbs | 362/219 X |
| 3,004,141 | 10/1961 | Waller et al. | 362/150 |
| 3,051,430 | 8/1962 | Halfaker | 362/366 X |
| 3,081,398 | 3/1963 | Karth | 362/150 |
| 3,154,001 | 10/1964 | Zurawski | 362/148 X |
| 3,209,137 | 9/1965 | Stahlhut | 362/150 |
| 3,336,471 | 8/1967 | Milner | 362/148 X |
| 3,375,322 | 3/1968 | Serio et al. | 362/150 X |
| 3,512,313 | 5/1970 | Harz | 362/150 X |
| 3,560,729 | 2/1971 | Liberman | 362/364 X |
| 3,591,794 | 6/1971 | Dail et al. | 362/150 X |
| 3,710,520 | 1/1973 | Federowicz | 362/150 X |
| 3,786,602 | 1/1974 | Wilkin | 362/150 X |
| 3,922,073 | 11/1975 | Schwartz | 362/148 X |
| 4,086,480 | 4/1978 | Lahm | 362/148 |
| 4,171,535 | 10/1979 | Westermann | 362/406 |
| 4,175,360 | 11/1979 | Mulvey | 362/150 X |
| 4,272,804 | 6/1981 | Blum | 362/148 X |
| 4,290,218 | 9/1981 | Drueck et al. | 362/150 X |

FOREIGN PATENT DOCUMENTS

| | | | |
|---|---|---|---|
| 669993 | 4/1952 | United Kingdom | 362/148 |

*Primary Examiner*—Peter A. Nelson

[57] ABSTRACT

A lighting fixture combined with a suspended ceiling in which ceiling panels are supported from channels and one or more fluorescent tubes are provided in a box or boxes supported by the channels and a lens or lenses are, arranged below the box and of the same shape as the ceiling panels so as to blend in with adjacent ceiling panels.

7 Claims, 11 Drawing Figures

PANEL CEILING AND LIGHT FIXTURE

BACKGROUND OF THE INVENTION

The present invention relates to a light fixture for a ceiling, and more specifically to a novel combination of such light fixture with a suspended ceiling. Such suspended ceiling ordinarily consists of hangers which position and support carriers in a level plane and to these carriers panels of several available profiles are attached.

It has been the practice up to now to have light fixtures suspended below the ceiling since the supportive chains for the carriers can pass through gaps between the ceiling panels. However, the appearance of the ceiling is interrupted by bulky fixtures for housing one or more lamps.

Another alternative has been to create rectangular openings for rectangular fixtures in which case the bottom of the fixtures are flush with or above the ceiling panels. Random size fixtures might not match the openings created by removing one or more panels. The fixtures suspended from the structural ceiling above the panels, for several reasons, may not fall in line with the openings made or left in the suspended ceiling. Such openings interrupt an otherwise smooth ceiling and leave the impression that the ceiling is unfinished. This is especially so when the lights are turned off.

It is, therefore, an object of the present invention to provide a new light fixture and ceiling combination which will overcome the above-mentioned disadvantages.

More specifically, it is an object of the present invention to provide a ceiling with panels, in combination with a light fixture and installation features, which will not interrupt the smooth appearance of a ceiling.

BRIEF DESCRIPTION OF THE DRAWING

The invention is illustrated, by way of example, in the attached drawings, in which.

DETAILED DESCRIPTION OF PREFERRED EMBODIMENTS

Figure 1:
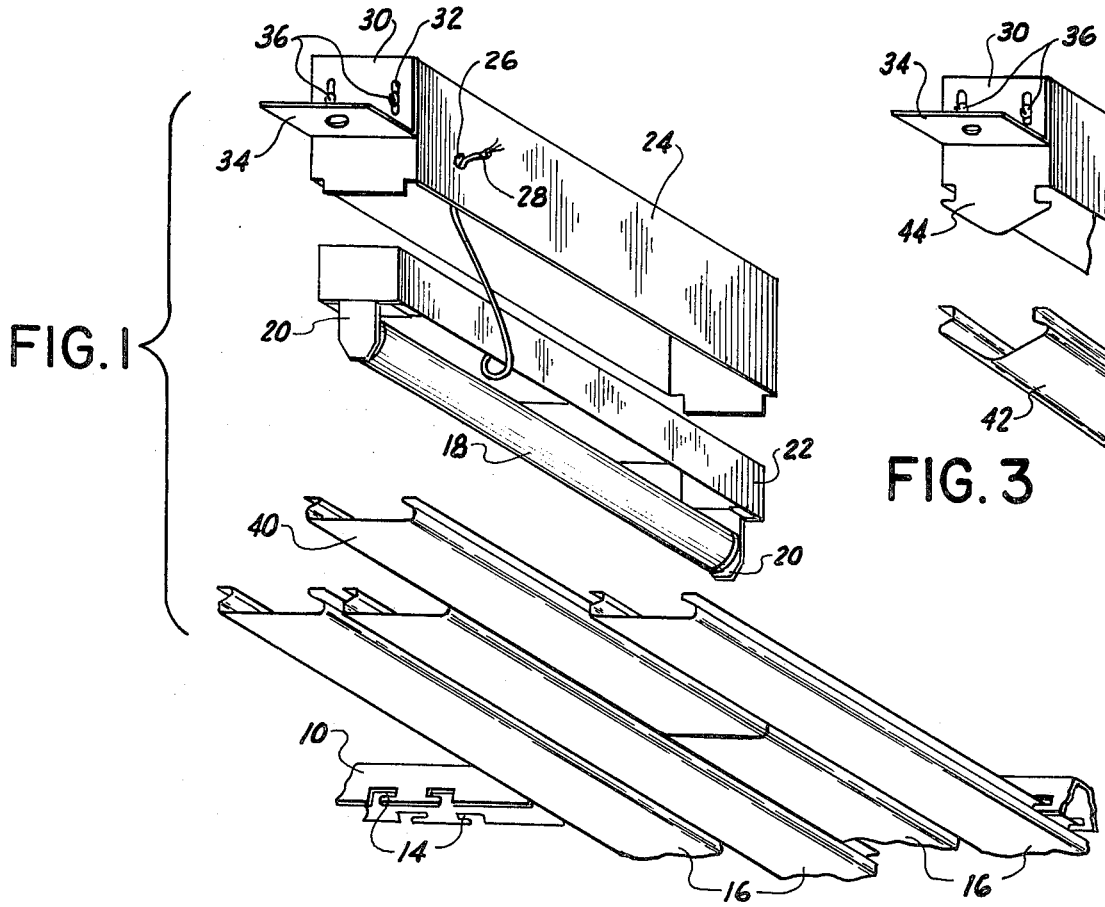
FIG. 1 is a perspective bottom view of the components of a ceiling and light fixture combination according to the present invention.
Figure 2:
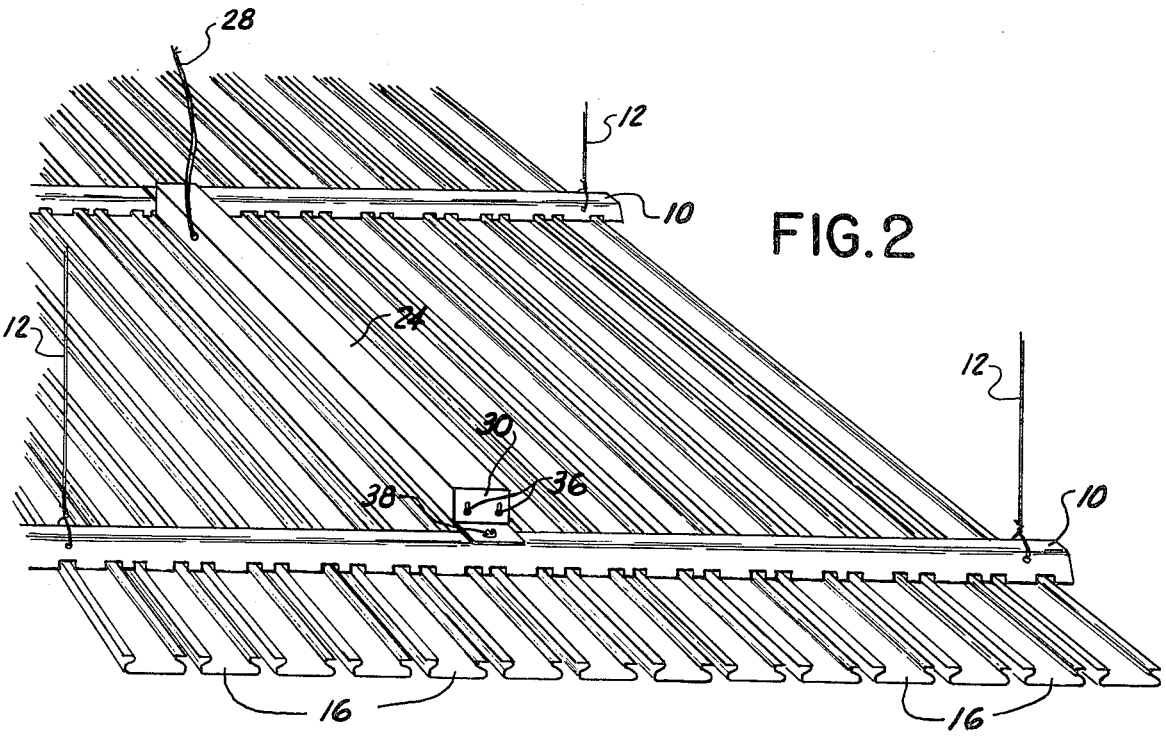
FIG. 2 is a perspective top view of the ceiling fixture mounted in the ceiling.

The suspended ceiling illustrated in FIGS. 1 and 2 comprise channels or carriers 10 suspended from a structural ceiling of a building or the like, by chains, rods, wires, or cables 12. Each channel 10 is provided with groups of slots 14 receiving therein ceiling panels 16 which are usually made of aluminum or other metal and extend across one or more channels 10, as indicated in FIG. 2. The structure described so far is well-known in the art.

Figure 4:
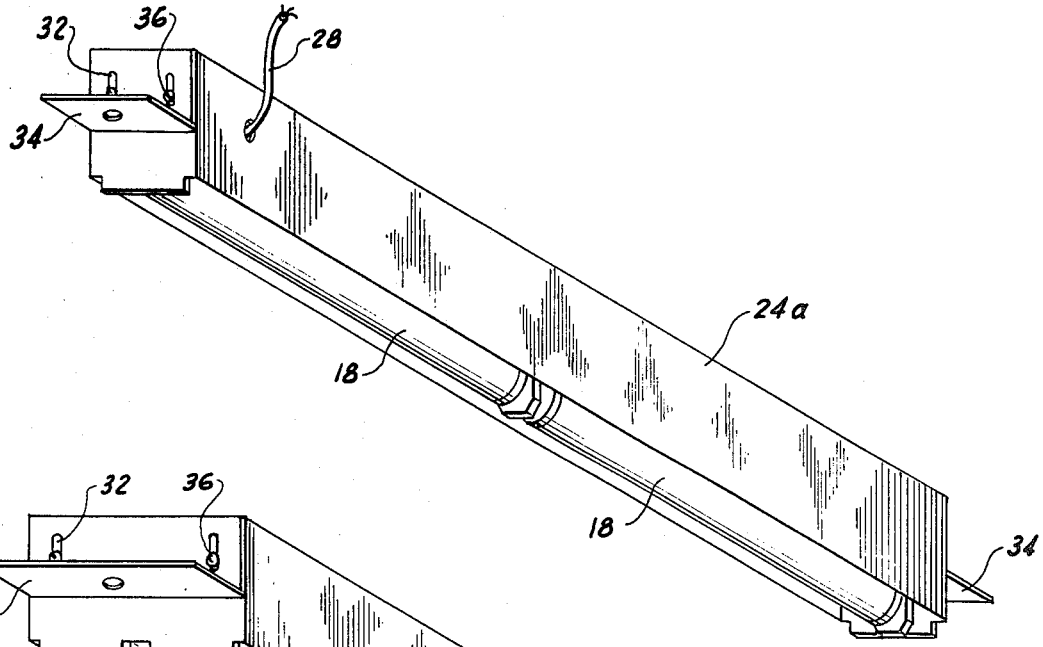
FIGS. 4 and 5 are perspective bottom views of modified fluorescent bulb arrangements and support boxes therefor for use in the lighting fixture ceiling combination of the invention.
Figure 5:
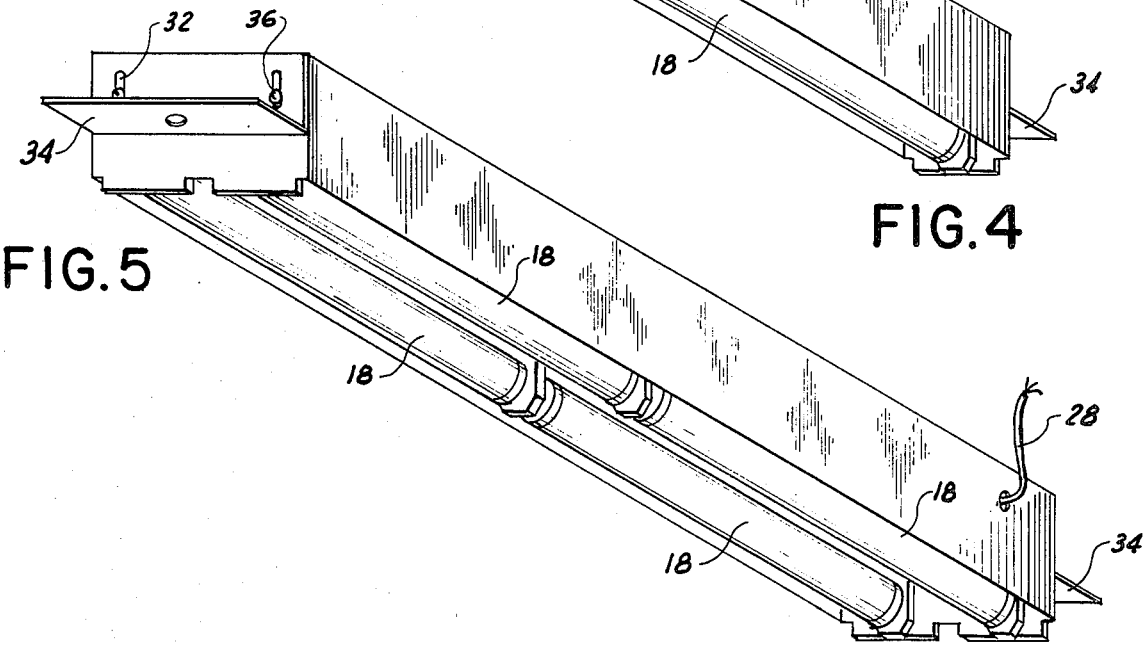

According to the present invention a lighting fixture is provided which combines in a novel manner with the ceiling. More specifically, a standard fluorescent tube 18 with sockets 20 and a housing 22 for the balast and other necessary items, is inserted in a box 24 having in one end or side thereof a hole 26 for electrical wires 28 providing electric power to the tube. Box 24 is also provided with brackets 30 at each end. Each bracket has oblong holes 32 permitting vertical adjustment of a horizontal plate 34 of the bracket relative to the housing 24. In this manner the level of the box relative to the suspended ceiling can be adjusted by loosening and tightening screws 36. The entire box 24 is fixed to carriers 10 by means of screws 38. It is to be understood that the box can be adapted to different available lengths of fluorescent tubes. Ordinarily a standard four-foot fluorescent tube is used. It is also understood that several of such tubes may be combined end to end or next to each other, as illustrated in FIGS. 4 and 5. In FIG. 4 box 24*a* contains two fluorescent tubes 18 in a row, while in FIG. 5, two rows of two fluorescent tubes 18 are arranged side by side. The ceiling panel immediately below the light fixture, as for instance the ceiling panel 40 in FIG. 1, is made of plastic transparent or translucent material, such as PVC, acrylic co-polymer styrene or polystyrene that is non-shattering and flame retardant, instead of the aluminum panel 16 used throughout the remainder of the ceiling.

The box 24 and the lighting fixture 18, 20, 22 are both painted white so as to reflect the majority of the light through the lens and with its profiled end pieces no light is dissipated above the ceiling. It is, of course, understood that the lens could be tinted to give a pink (warm) light, or blue (cool) light or green (restful) light.

The lens 40 matches the aluminum panels when the light is turned off. The light fixture serves as a reflector fastened to the suspended ceiling and transmits light only through the panel directly below it. The closed ends of the box conform to the shape of the panel.

Figure 3:
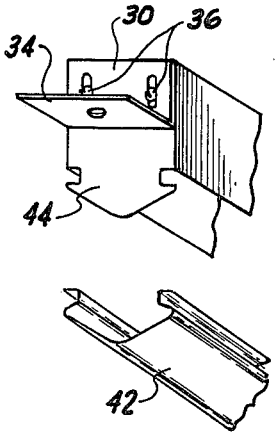
FIG. 3 is a partial perspective bottom view of a light fixture and lens combination modified over that shown in FIG. 1.

The panels 16 and 40 do not have to have an essentially flat bottom as shown in FIGS. 1 and 2, but may have different shapes. FIG. 3 shows an alternative embodiment in which the panel 42 is essentially triangular. The end panel 44, of the box for the fluorescent tube is adapted accordingly.

Figure 8:
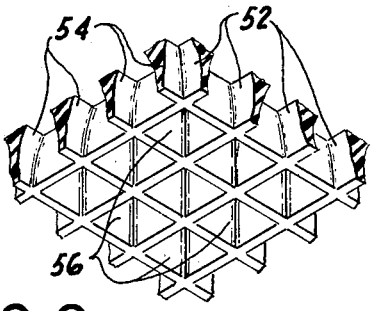
FIGS. 8, 9 and 10 show details of lenses usable in the ceilings of FIGS. 6 or 7.
Figure 6:
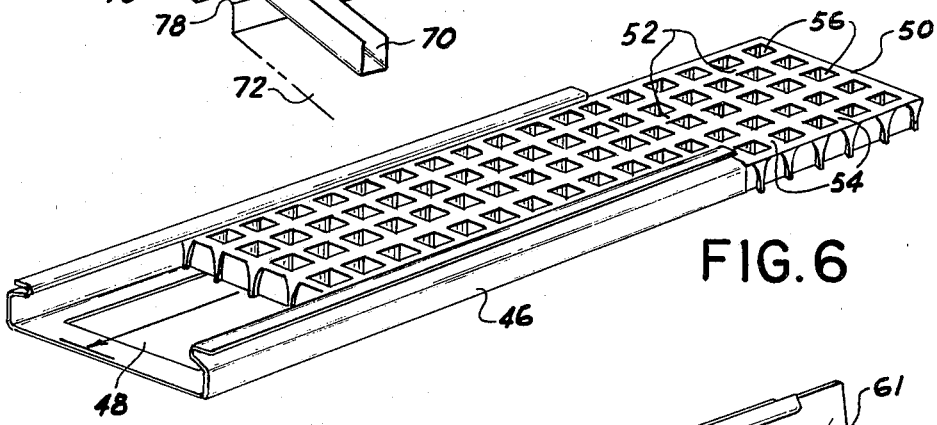
FIGS. 6 and 7 show ceiling panels and lenses modified over those of FIGS. 1 and 3.

While FIGS. 1 to 3 show a lens made of a plastic transparent or translucent material which is plain throughout the present invention contemplates the use of other such lenses. For example, FIG. 6 shows an aluminum panel 46 having as essentially rectangular cut-out 48 and receiving therein above cut-out 48 a lens 50. Lens 50 comprises longitudinal and transverse ribs 52 and 54 respectively leaving openings 56 therebetween (see also FIG. 8). Ribs 52 and 54 are wider at the top than at the bottom and each wall confining an opening 56 has a highly polished metallized finished surface to form a mirror. The lens is made from virgin acrylic or polystyrene, with said metallized surface covered by a clear lacquer.

Figure 7:
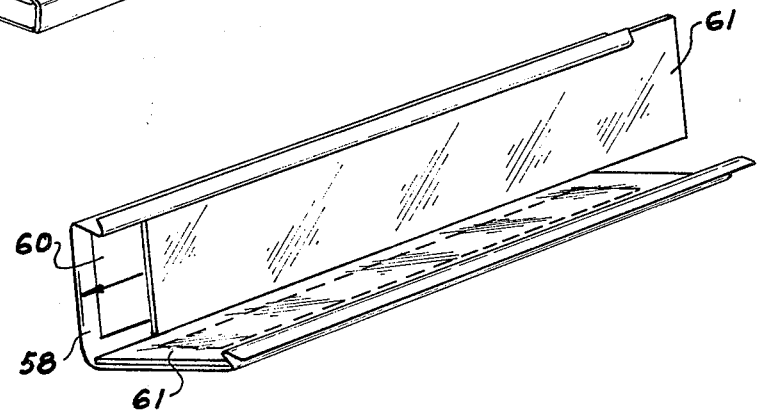

In still another form shown in FIG. 7, a U-shaped metal panel 58 (such as aluminum) having two cut-outs 60 receives a lens 61 over each opening. The lenses may have a glass-like surface characteristic or may have those shown in FIG. 9 or 10, i.e. a honey-comb like or some geometric profiled surface 64 or an irregular diffusing surface 66. Lenses 61, 62 and 68 are made from virgin acrylic, styrene, or polystyrene.

Figure 11:
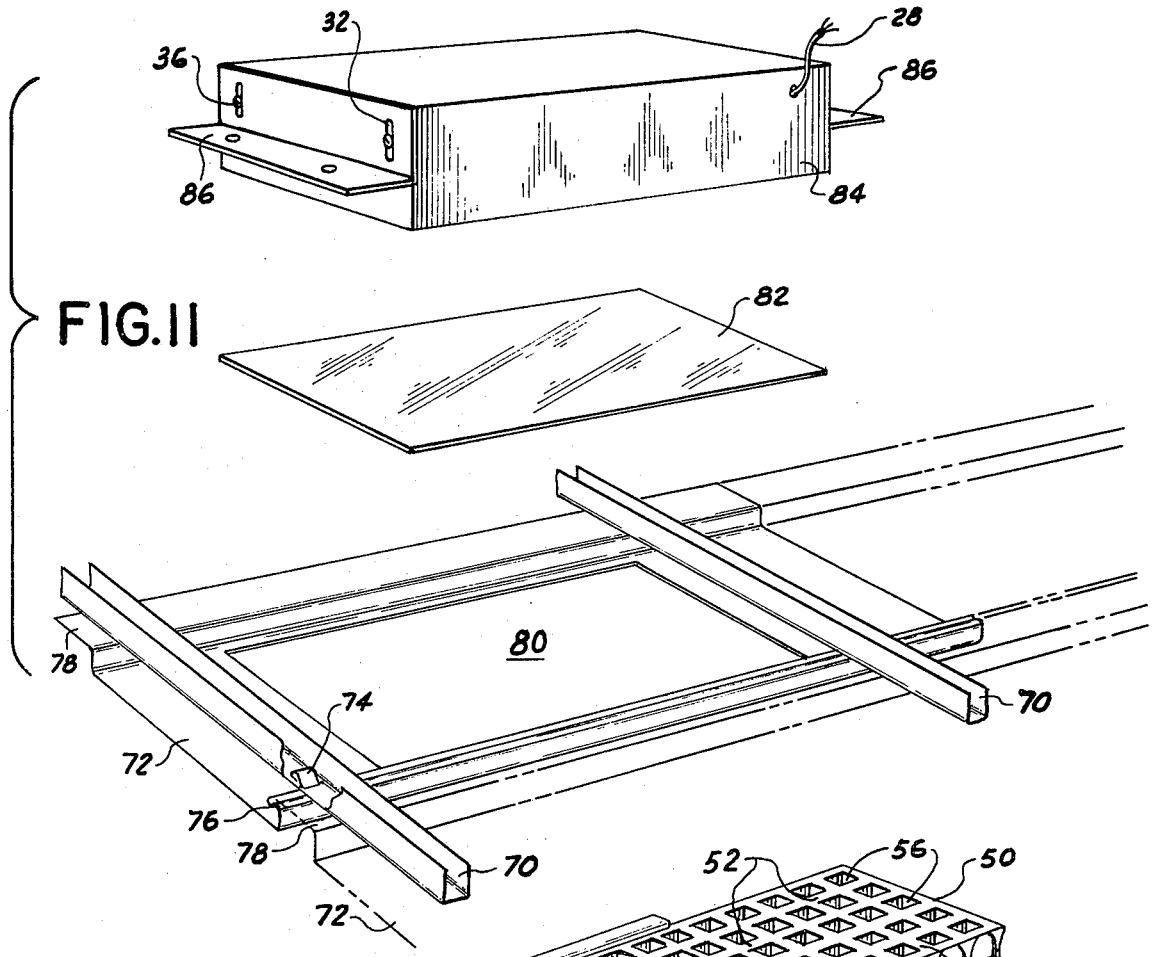
FIG. 11 is a perspective view of a modified ceiling and lighting fixture combination.

FIG. 11 shows in an exploded, perspective view a modified ceiling and lighting fixture combination. Instead of the essentially U-shaped channels shown in FIG. 2 the combination shown in FIG. 11 has U-shaped channels 70 opening upwardly. Ceiling panels 72 are suspended from the channels by fingers 74. Each finger simultaneously supports a flange 76 of one panel and flange 78 of an adjacent panel.

Figure 9:
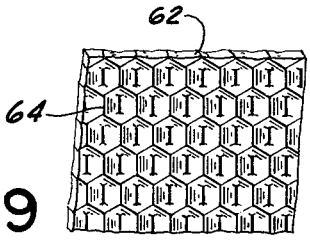
Figure 10:
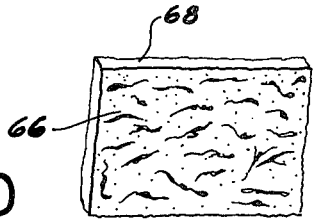

The panel below a lighting fixture is provided with a cut-out 80 to be covered with a lens 82 of a material similar to or like that of lenses 61, 62 or 68 shown in FIGS. 7, 9, and 10, respectively. In a manner similar to that described above the lighting fixture is mounted in a box 84 having brackets 86 to be supported on channels 70.

It is, of course, to be understood that the present invention is not limited to the embodiments shown and described above but only by the scope of the appended claims.

I claim:

1. In a suspended ceiling: channel means suspended from a support, a plurality of elongated ceiling panels arranged parallel to each other and supported by said channel means essentially perpendicular thereto in an essentially horizontal plane, at least one lighting fixture including fluorescent tube means housed in a box-shaped housing, and lens means arranged below said lighting fixture and being of the same shape as said ceiling panels so as to fully blend therewith.

2. The combination of claim 1, wherein said ceiling panels are made from metal and essentially U-shaped with a relatively flat bottom remote from said channel means and flanges, said channel means having grooves respectively receiving said flanges, said lens means being made of an at least partially transparent material and being essentially U-shaped with a relatively flat bottom forming on extension of adjacent bottoms of adjacent panels and with flanges received by said grooves.

3. The combination according to claim 1, wherein said ceiling panels are made from metal and essentially V-shaped with the tip of the V pointing away from said channel means and with flanges, said channel means having grooves respectively receiving said flanges, said lens means being made of an at least partly transparent material and being essentially V-shaped with the tip of the V forming an extension of adjacent V's of adjacent panels, and with flanges received in said grooves.

4. The combination of claim 1, wherein said ceiling panels are made from metal and essentially U-shaped with a relatively flat bottom remote from said channel means and flanges, said channel means having grooves respectively receiving said flanges, said lens means comprising a panel of a material and shape corresponding to that of said ceiling panels and having a cut-out in its bottom and having a lens of at least partially transparent material covering said cut-out.

5. The combination according to claim 1, wherein said ceiling panels are made from metal and essentially V-shaped with the tip of the V pointing away from said channel means and with flanges, said channel means having grooves respectively receiving said flanges, said lens means comprising a panel of a material and shape corresponding to that of said ceiling panels and having a cut-out in at least one of the sides of said V and a lens of at least partially transparent material covering said cut-out.

6. The combination according to claim 1, wherein said ceiling panels are made from metal and essentially V-shaped with the tip of the V pointing away from said channel means and with flanges, said channel means having grooves respectively receiving said flanges, said lens means comprising a panel of a material and shape corresponding to that of said ceiling panels and having a cut-out in both sides of said V, and two lenses of transparent material covering said cut-outs in said sides.

7. The combination of claim 1, wherein said ceiling panels are made from metal and essentially U-shaped with a relatively flat bottom remote from said channel means and flanges, said channel means having grooves respectively receiving said flanges, said lens means comprising a panel of a material and shape corresponding to that of said ceiling panels and having a cut-out in its bottom and a lens located in said panel above said cut-out and including a grid-like structure with openings therein permitting light from said fluorescent tube means to penetrate.

* * * * *